United States Patent [19]

de Nora et al.

[11] Patent Number: 4,834,850

[45] Date of Patent: May 30, 1989

[54] EFFICIENT ELECTROLYTIC PRECIOUS METAL RECOVERY SYSTEM

[75] Inventors: Vittorio de Nora, Nassau, The Bahamas; Robert D. Penny; Lawrence L. Frank, both of Concord, Ohio; Anthony J. Vaccaro, Madison; James J. Stewart, Chardon, both of Ohio

[73] Assignee: ELTECH Systems Corporation, Boca Raton, Fla.

[21] Appl. No.: 78,361

[22] Filed: Jul. 27, 1987

[51] Int. Cl.[4] ..... C25C 1/20; C25C 7/00

[52] U.S. Cl. ..... 204/109; 204/149; 204/228; 204/235; 204/237; 204/270; 204/278; 204/279; 204/284; 204/292; 204/433; 204/269

[58] Field of Search ..... 204/228, 284, 269, 240, 204/109, 152, DIG. 13, 149, 271, 270, 275, 277, 278, 290 R, 279, 235, 238, 237

[56] References Cited

U.S. PATENT DOCUMENTS

| | | | |
|---|---|---|---|
| 2,248,718 | 7/1941 | Owen | 204/297 R X |
| 3,069,345 | 12/1962 | Lowdermilk et al. | 204/297 R X |
| 3,141,837 | 7/1964 | Edelman | 204/43 |
| 3,331,763 | 7/1967 | Mabey | 204/281 |
| 3,431,187 | 3/1969 | Lancy | 204/109 |
| 3,650,925 | 3/1972 | Carlson | 204/153 |
| 3,804,733 | 4/1974 | Bennion et al. | 204/151 |
| 3,953,313 | 4/1976 | Levenson | 204/269 X |
| 4,034,422 | 7/1977 | Farber et al. | 4/187 |
| 4,039,422 | 8/1977 | Packer | 204/272 |
| 4,097,347 | 6/1978 | Packer | 204/109 |
| 4,139,432 | 2/1979 | Scheidegger et al. | 204/109 |
| 4,171,255 | 10/1979 | Tuznik et al. | 204/238 |
| 4,276,147 | 6/1981 | Epner et al. | 204/272 |
| 4,312,716 | 1/1982 | Maschler et al. | 204/224 R X |
| 4,326,938 | 4/1982 | Das Gupta et al. | 204/228 |
| 4,336,124 | 6/1982 | Gerard et al. | 204/284 |
| 4,384,939 | 5/1983 | Kim et al. | 204/110 |
| 4,399,020 | 8/1983 | Branchick et al. | 204/269 |
| 4,436,601 | 3/1984 | Branchick et al. | 204/149 |
| 4,515,672 | 5/1985 | Platek et al. | 204/269 |
| 4,585,539 | 4/1986 | Edson | 204/228 |

*Primary Examiner*—Donald R. Valentine
*Attorney, Agent, or Firm*—John J. Freer

[57] ABSTRACT

An efficient electrolytic recovery system, having several safety mechanisms, for recovering precious metals from a liquid medium is described. The system includes at least oen electrolysis cell unit having a plurality of reticulate metal foam cathodes. The system of the invention will efficiently recover such precious metals as Au, Ag and Pt. The system may also include a pH adjust means and a means for oxidizing cyanide in the liquid medium.

27 Claims, 12 Drawing Sheets

ELECTROLYTIC CELL

DRAWING OF CATHODE CLIP

EFFICIENT ELECTROLYTIC PRECIOUS METAL RECOVERY SYSTEM

BACKGROUND OF THE INVENTION

1. Field of the Invention

This invention relates to an efficient, highly effective system and method for recovering precious metals contained in a liquid. More specifically, the system employs at least one electrolysis cell unit containing two or more reticulate metal foam cathodes. The system may also contain a means of chemical addition and a filtering means to reduce the particulate content and base metal content contained in the liquid in order to provide a uniform electrolyte flow distribution. The system may be used to recover such precious metals as Au, Ag, and Pt.

2. State of the Art There are many applications where it is necessary or desirable to recover a precious metal from solution. For example, in the manufacture of jewelry, precious metal such as gold or silver are plated onto a base metal. Some of the precious metal accumulates in a rinse solution known as the drag-out rinse during the plating process and would be lost if not recovered from the drag-out rinse. Environmental considerations require the removal of metal pollutants such as mercury, cadmium and silver, from solution to prevent the discharge of metal pollutants into sewers and sewage treatment facilities. Photographic processes require the recovery of silver which accumulates in solution during the photographic development process. It is apparent that the simple, efficient and economic recovery of a variety of metal from solution would be highly desirable and beneficial.

There have been numerous efforts, extending over a long period of time, to provide such a simple, efficient and economic system for recovery of precious metals from solution. These efforts have generally been directed to methods and apparatus for electroplating the metal dissolved in the solution onto a cathode in an electrolytic recovery cell. Such electrolytic recovery cells generally comprise a cathode and anode mounted in spaced apart relationship within a housing and connected to a source of DC current. The housing is positioned in a recovery tank. The solution containing the metal is pumped to the recovery tank and through the recovery cell and the metal plated out on the cathode. Periodically, the cathode is removed from the cell and processed to recover the metal.

One of the major drawbacks in the use of these prior art electrolytic precious metal recovery systems has been the codeposition of unwanted metals together with precious metals on the cathode. A variety of unwanted cation components may be present in the solutions as a result of water hardness, metals dissolved from items being plated, or a gradual build-up of impurities with time. These impurities plate at the cathode, together with precious metal being recovered. A fouling of the cathode surface and loss of product purity can occur.

Another major drawback of these prior art systems has been the construction and method of installation of the cathode used in the recovery cell. It is known that the rate and thoroughness of metal recovery during cathodic deposition is depended upon the cathodic surface area contacting the solution being processed. In order to deal with very dilute solutions or solutions with a high rate of flow, these prior art systems have had to provide electrolytic cell housings which allow for addition of cathodes or enlargement of the size of the cathodes in order to increase cathodic surface area. These provisions for increasing or decreasing cathode surface area are expensive and often involve interrupting the process to accomplish.

Cathodes, which have been employed in cells for recovery of gold from solution, have generally been formed of a metal such as stainless steel, titanium or tantalum wire mesh plated with nickel. A typical example is disclosed in U.S. Pat. No. 4,907,347. To increase the total surface area of the cathode, multiple cathodes have been used, such as disclosed, for example, in U.S. Pat. No. 4,034,422. U.S. Pat. No. 3,331,763 discloses a recovery cell for recovering copper from solution which uses a cathode formed from a plastic sheet laminated between two copper sheets. U.S. Pat. No. 3,141,837 discloses a cathode formed of a substrate of glass or plastic sheet having a metallized surface used for electrodeposition of nickel-iron alloys. U.S. Pat. No. 3,650,925 discloses the use of a cathode formed of an electrically-conductive carbonaceous material such as graphite or carbon used for recovery of various metals from solution.

U.S. Pat. No. 4,276,147 discloses a recovery cell for precious metals that is placed directly into a tank containing the metal solution. The single cathode of the electrolytic cell is of a cylindrical construction formed from a cellular non conductive base layer having an outer layer of conductive material. U.S. Pat. No. 4,384,939 discloses a method and apparatus for the removal of precious metals, such as gold, contained in a liquid in low concentration. The cell unit contains a perforated metal cathode cylinder fitted inside a perforated metal anode cylinder. Both the cathode and anode have screw-type structures which permit electrical connection with the outside of the container. U.S. Pat. No. 4,039,422 discloses a unit for the recovery and removal of metal from solution. The unit employs a series of concentric cylindrical wire mesh electrodes. Furthermore, electrolytic cells having reticulate electrodes have been developed for the recovery of metal ions from various waste streams. For example, U.S. Pat. No. 4,515,672 discloses a reticulate electrode and cell for recovering metal ions from metal plating waste streams and the like. U.S. Pat. No. 4,463,601 discloses a membrane or diaphragm-free, electrolytic process for removal of a significant portion of contaminant metals from waste water. The cell used for this process utilizes reticulate cathodes. U.S. Pat. No. 4,399,020 discloses a membrane or diaphragm free electrolytic cell for the removal of metals present as contaminants in waste water. The metal contaminants are deposited on reticulate cathodes.

None of the foregoing patents disclose a system such as described herein which recovers precious metal from a liquid combined with a unit for chemically treating the waste liquid prior to electrolysis, and the capability of easily changing cathode surface area to deal with changes of solution flow rate and concentrations.

SUMMARY OF THE INVENTION

A novel electrolytic method and system for the efficient recovery of precious metals from a liquid has been developed. The system is effective for the safe and the high rate recovery per unit of time of such precious metals as Au, Ag and Pt.

In accordance with the present invention, an electrolytic system is provided for the high rate recovery of precious metals comprising at least one means for addition of a controlled amount of reactant for precipitation of unwanted contaminants; filtering means for providing a substantially particulate free liquid filtrate for electrolysis; at least one electrolysis cell unit containing two or more flow through reticulated metal foam cathode assemblies mounted in the cell in such a manner as to provide for easy replacement with cathodes of an alternate porosity and a flow through foraminous anode assemblies; and feed means for recycling at least a portion of the electrolysis cell effluent for return to said containing means.

Further in accordance with the present invention, an electrolytic recovery system for precious metals is provided that further comprises a pH adjust means for adjusting the pH of the precious metal containing liquid in order to improve the safety, the product purity and the rate of deposition of the precious metal for the system.

Still further in accordance with the present invention, an electrolytic recovery system is provided that comprises two or more electrolysis cells which may be connected in series, in parallel or at least one cell may be by passed by a switching means.

Still further in accordance with the present invention, an electrolytic recovery system is provided that comprises an electrolysis unit which comprises a plurality of reticulate metal foam cathodes mounted into the cell in a manner to allow for easy replacement, and having a pore size that may range from about 10 pores per inch (ppi) to about 100 ppi.

Still further in accordance with the present invention, an electrolytic recovery system is provided that also may comprise a means for oxidizing cyanide that may be present in the precious-metal-containing liquid in order to reduce the toxicity of the discharge effluent from the electrolysis cell.

Still further in accordance with the present invention, an electrolytic recovery system is provided that may comprise a means for monitoring the pH of the electrolysis discharge effluent and if the pH reaches a predetermined pH value an alarm is activated in order to improve the safety of the system.

Still further in accordance with the present invention, an improved electrolytic system for the high rate of recover of precious metals per unit of time comprising: a chemical agent reservior comprising means for the addition of a controlled amount of said agent to a precious metal containing liquid for treatment; and, at least one electrolysis cell unit containing two or more flow through reticulated metal foam cathode assemblies and corresponding flow through foraminous anode assemblies is provided.

Still further in accordance with the present invention, a method for the efficient recovery of precious metal solubilized or dispersed in a liquid medium is provided wherein the method comprises: providing a precious-metal-containing liquid for treatment, said liquid containing precious metal in an amount sufficient for recovery; feeding into said liquid a chemical agent in sufficient quantity to cause precipitation of unwanted contaminants; feeding said liquid to a filtering means to obtain a precious-metal-containing liquid filtrate; feeding said liquid filtrate to at least one electrolysis cell unit comprising two or more reticulated metal foam cathode assemblies and foraminous anodes to effect the disposition of said precious metals on the cathode; and, optionally, returning at least a portion of the resulting precious-metal-depleted effluent for blending with fresh liquid.

These and other aspects of the invention will become clear to those skilled in the art upon the reading and understanding of the specification.

The invention will be further described in connection with the attached drawing figures showing preferred embodiments of the invention including specific parts and arrangements of parts. It is intended that the drawings included as a part of this specification be illustrative of the preferred embodiments of the invention and should in no way be considered as a limitation of the scope of the invention.

DETAILED DESCRIPTION OF THE PREFERRED EMBODIMENTS

The electrolytic recovery system of the invention has been designed for use on an industrial scale as well as in the shops of jewelers and gold and silver platers. The system is efficient in that a major portion of the precious metal contained in the particular liquid is deposited on the cathodes of the electrolysis cell(s) of the system during the first cycle of the liquid through the system. Therefore, the amount of recycling of the precious-metal depleted liquid is reduced. Also, in a preferred embodiment where caustic (e.g., NaOH, KOH) is used as a reactant to precipitate unwanted contaminants and increase solution pH and conductivity for proper plating, the system safety is further enhanced by ensuring that any hydrogen cyanide gas or chlorine gas evolved in the electrolytic cells is fully absorbed due to alkalinity of the electrolyte solution.

As previously mentioned, the electrolytic recovery system according to the invention comprises at least one electrolysis cell unit. The number of units integrated into the system is dependent upon the particular scale to which the system is to be put to use. A system, for example, to be used on an industrial scale will obviously require more cell units than a system to be used in a gold plater's shop. The cell found to be most suitable for the purposes of the present invention is one that has a plurality of reticulate metal foam cathodes. This cell has the advantages of having two or more cathodes as opposed to a single cathode, much greater surface area for the cathode due to its porosity, as well as being porous to the liquid. Cathodic surface area may be easily changed to deal with differing solution flow rates by connecting cells in either a series or parallel relationship to the solution flow; by replacing cathodes with cathodes of varying porosity; or by varying porosity along the flow path of the solution to compensate for metal removal. These advantages result in a more complete deposition of precious metal on the cathode and thus a more efficient system is provided. Such an electrolysis cell unit described, e.g., in U.S. Pat No. 4,515,672 which is expressly incorporated herein by reference for such disclosure.

Figure 2:
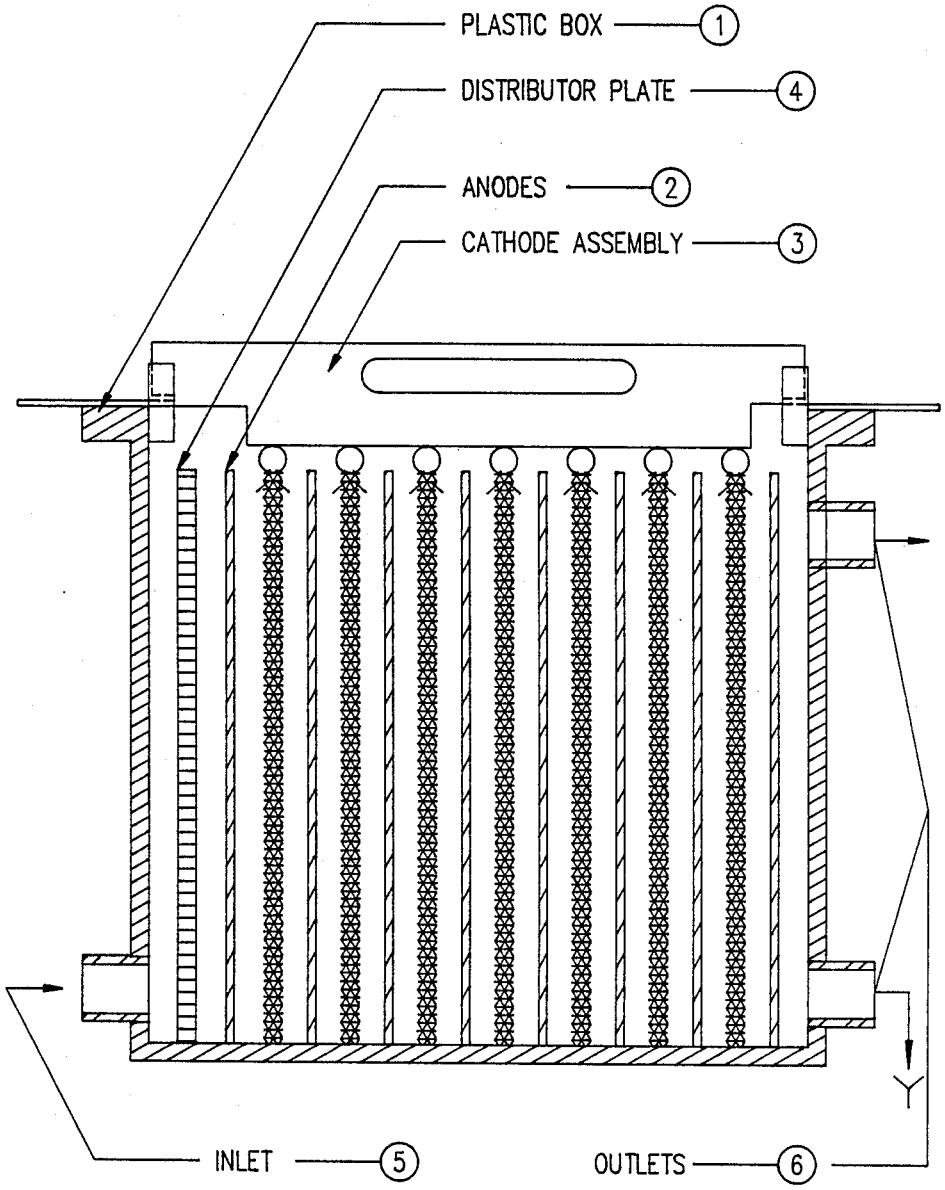
FIG. 2 is a side view of a cell with reticulate metal foam cathode assembly in accordance with the invention.
Figure 3:
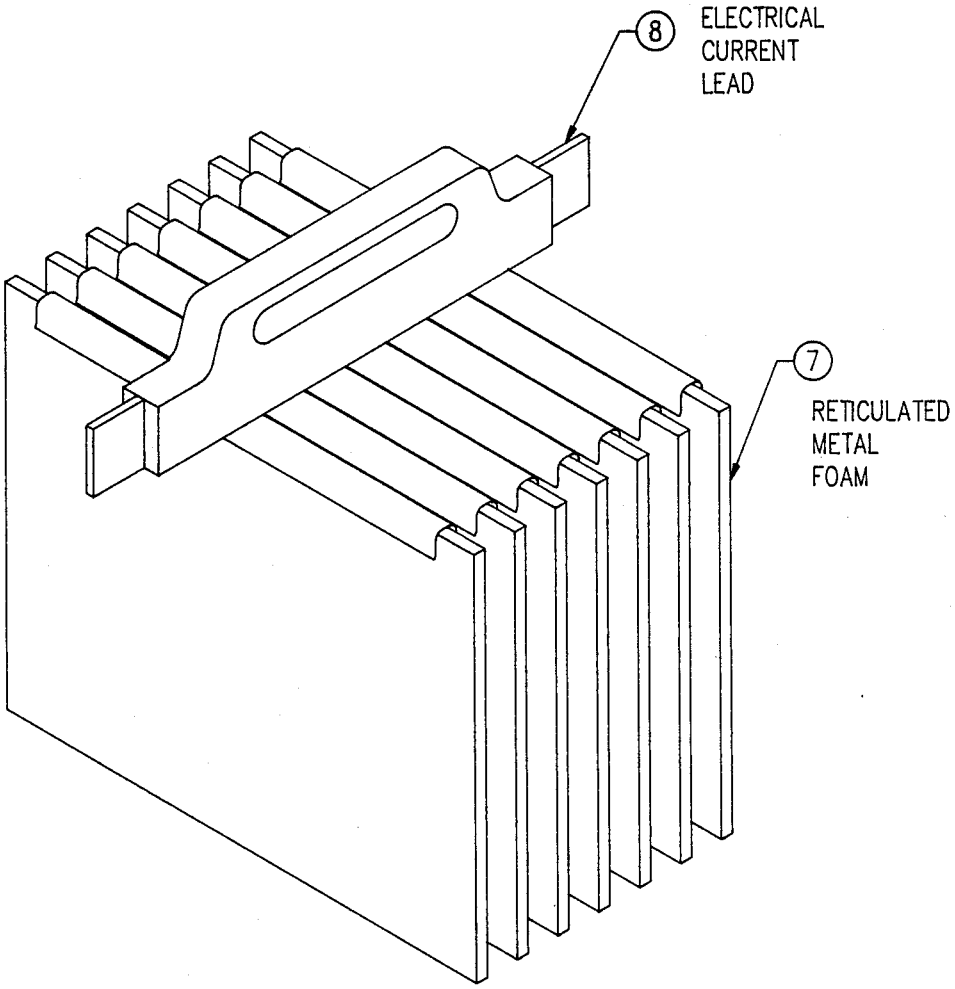
FIG. 3 is a magnified view of part of a multiple cathode assembly.

More specifically, an electrolysis cell useful in the present invention is illustrated in FIG. 2 and a preferred cathode assembly in FIG. 3. FIG. 2 shows the cell constructed of a plastic box 1. The box is equipped with a plurality of conductive mesh anodes 2 and reticulated cathode assembly 3 as well as a flow distributor 4 and an inlet 5 and outlet ports 6. Anodes and cathodes have an open structure which allows the electrolyte to circulate through the electrodes from the inlet to the outlet of the cell. The cell outlet is higher than the inlet which is the reverse of typical or similar cell units. This feature increases the efficiency of the system as well as further enhancing system safety.

The cell operates at atmospheric pressure thus eliminating operating problems associated with pressurized cells. The cell may be operated in a batch or a continuous mode.

The cathode assembly 3 presented in FIG. 3 consists of reticulated metal foam (a metallized polymeric foam), 7, and an electrical current lead 8. The reticulated metal foam cathode 7 is pressed into the electrical current lead 8 to provide a good electrical contact between the current lead and the metal as well as to ensure the necessary mechanical rigidity and gripping to the foam. The contact is enhanced by designing the clip or electrical current lead to have a flare on the grooved or cell side of the lead and by providing the cathode with a rounded corner or edge for a better contact in the groove of the lead. This is a difficult task since, on the one hand, too much pressure will change physical dimensions of the foam reducing its mechanical strength and, on the other hand, too little pressure will provide insufficient electrical contact. Preferably, reticulated cathodes made from nickel foam have the electrical current lead made from nickel and the copper cathodes have a current lead made from copper, however, any suitable conductive metal may be used. As already mentioned, the current lead is designed so as to allow proper bonding to the reticulated metal foam and thus it may be replaced with any other suitably designed conductor which will ensure intimate contact without affecting the mechanical stability of the reticulated metal and a good electrical contact. The porosity of the reticulated foam may range from about 100 pores per inch (ppi), to porosities of about 10 pores per inch (ppi) may be employed for solutions with higher metal ion concentrations (e.g., about 10–15 g/l). When the electrolyte content of precious metal ions is very high (e.g., more than 20 g/l), it is possible to use mesh cathodes of various sizes or even perforated plates, as opposed to reticulated foam.

As mentioned above, the anodes may be made by welding a titanium mesh to a frame made from titanium strips. The construction allows a uniform current distribution and provides a good electrical contact with the anode current lead and a rigid structure.

Optionally, the cell may include a cover. The cover is designed such that all gases generated in the electrolytic cell easily escape through the open structure of the cover, thus preventing any explosive build-up of hydrogen and oxygen.

The cell may further include a porous flow distributor 4 made of perforated or sintered polyethylene or polyvinyl chloride. The distributor is used to ensure uniform flow of the electrolyte through the electrodes and the cell. The porosity of the distributor is selected to provide a uniform flow and does not create a significant pressure drop at the operating flow rates.

A feature of the described cell is that the cathodes, of rectangular shape, are slidable into vertical grooves in the cell box. The cathodes are arranged into a holder which also serves as a current distributor. The holder further serves as a means of easily removing one group of cathodes and inserting a second group of cathodes at one time as a cartridge. This feature is an additional advantage of the electrolytic system of the present invention.

Figure 1:
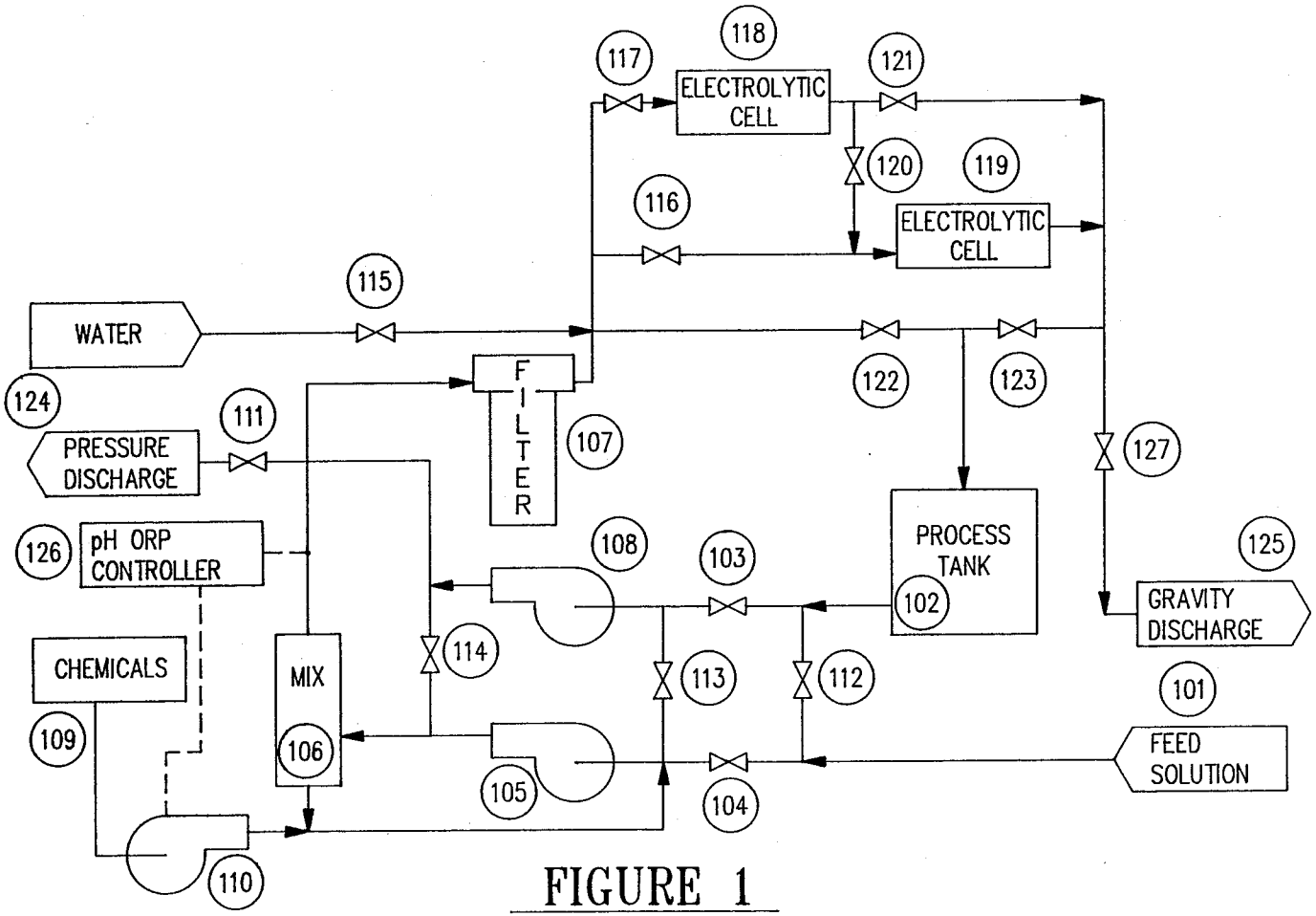
FIG. 1 is a schematic flow diagram for one embodiment of the electrolytic recovery system according to the present invention including electrolysis cell units, filtering means, pH adjust means and a holding tank for the precious-metal-containing liquid.

Referring now to FIG. 1, one embodiment of the electrolytic recovery system of the invention is illustrated in this schematic flow diagram. The electrolysis cells 118 and 119 are described above. The precious-metal-containing liquid source 101, e.g. plater's drag out rinse or waste water, is fed to holding tank 102. Valves 103 and 104 allow for precious-metal-containing liquid to enter the system only from holding tank 102, only from the source 101 or from both the tank 102 and the source 101. This liquid for electrolysis is pumped by pump 105 to reaction tank 106 for pH adjustment. Caustic, e.g., NaOH, is introduced into the liquid stream from reagent reservoir tank 109 by pump 110 where the pH of liquid leaving reaction tank 106 is measured at 126 by, e.g., a standard pH meter/controller (or oxidation/reduction probe).

The liquid leaving the reaction tank 106 passes through filter 107. For the purposes of the present invention, a canister type filter is preferred. Other filtering devices, however, may be employed. The liquid leaving filter 107 passes into the electrolysis cell units 118 and 119. Valves 117, 116, 120 and 121 allow for the series or parallel connection of the cells 118 and 119 or to allow for by-passing one of the cells. For example, with valves 117 and 121 open while valves 116 and 120 closed, cell 119 is by-passed. If valves 116, 117 and 121 are open with valve 120 closed, the cells 118 and 119 are connected in parallel. Likewise, by opening valves 117 and 120 while closing valves 116 and 121, the cells are connected in series. These options provide a versatile system for handling a variety of different liquids. For example, the option of by-passing one of the cells allows for the handling of a smaller quantity, i.e., low volume, of liquid. If, however, a large volume of liquid is to be treated, the option of connecting the cells in parallel would most advantageously be selected. This feature of the electrolytic recovery system of the invention provides not only increased efficiency over systems now available but also much greater versatility and flexibility to the ultimate user.

Valves 122, 123 and 127 are provided to either recycle a portion of the discharge precious-metal-depleted effluent to holding tank 102 by opening valve 122 or 123 or to draw off the effluent by gravity discharge at 125 when valve 127 is opened. The pump 108 may be used to discharge solution under pressure to an elevated receiver 124 by opening valve 111. Valves 112, 113 and 114 may be used to interchange functions of the two pumps. Water may be introduced through valve 115. Additionally, a blower, not shown, may be provided for each of the electrolytic cells to remove any gases generated during the operating of the unit. This provides an added safety feature for the system.

Other safety features may be included in the system. For example, most drag out rinses from gold plating operations will contain solubilized gold in a cyanide solution. Cyanide presents a safety hazard and disposal problem due to its toxicity. Therefore, a means for oxidizing the cyanide to carbon dioxide and nitrogen may be included in the system. Such means may include metering an oxidizing agent such as an alkaline hypochlorite solution into the solution being processed via reservoir 109 and pump 110 with an ORP probe at point 126 controlling addition. In the alternative, a salt solution, e.g., NaCl, may be introduced from reservoir 109 such that a hypochlorite solution is generated in the electrolytic cells. Furthermore, the pH of the discharge effluent may be monitored by a monitoring means, e.g., a standard pH meter. If the effluent becomes too acidic, e.g., below a pH of 5.0, an alarm may be activated or, alternatively the pH may be adjusted by the addition of caustic.

The pH adjustment of the solution to be treated may be advantageous for several reasons. An initial pH adjustment (i.e., of cell feed) is beneficial to "scrub" any HCN gas that may be generated during gold deposition and thus prevent its release to the air, i.e., in-situ scrubbing. In other words, this insures that the solution being treated is not acidic so as not to promote HCN evolution.

An initial pH adjustment is also beneficial to increase the solution conductivity (it is noted that generally a plater's waste solution is close to neutral pH). By increasing conductivity the required current may be passed at relatively low voltage (see FIG. 9) to achieve high removal efficiency.

Furthermore, the discharge liquid from the cells may be adjusted to a neutral pH (e.g., by adding acid or acidic buffer) which may be required for discharge or disposal.

The foregoing benefit is provided by the electrolytic system of the invention by the inclusion of a pH adjust component which is not found in the systems disclosed in the art. Also, tank 102 may further be provided with an overflow alarm. This alarm would be activated if the level in the tank reached a predetermined level due to, e.g., high flow rate, valve malfunction and the like. These and other safety features other than specific ones discussed above are contemplated within the scope of the invention. However, these features provide additional advantages over electrolytic recovery systems presently available and described in the technical literature.

Figure 4:
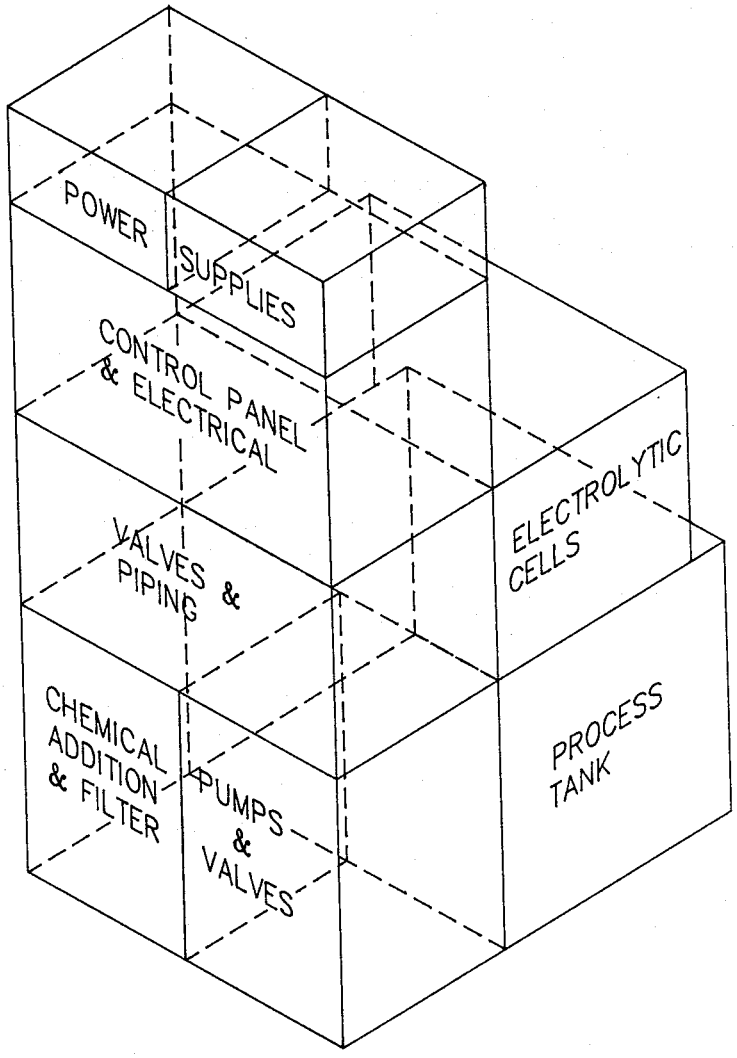
FIG. 4 is an isometric layout for one embodiment of the invention illustrating the major components of the electrolytic system of FIG. 1.

FIG. 4 shows an isometric layout of one embodiment of the electrolytic system of the present invention. This Figure illustrates a general arrangement of the different components of the electrolytic system according to the invention.

The invention is further illustrated in the following examples. While these examples will show one skilled in the art how to operate within the scope of this invention, they are not to serve as a limitation on the scope of the invention where such scope is defined only in the claims.

EXAMPLE I

The electrolytic recovery system of the present invention was tested under different operating conditions to measure the rate of recovery under these different conditions. A cell as illustrated in FIG. 2 having reticulate nickel cathodes, polyvinyl chloride distributor plates with 0.065" holes and a 1" outlet was utilized for conducting the following tests. The precious metal recovered was gold.

Gold Recovery Rates vs. Inlet Concentrations

The gold recovery rate for the invention recovery system was determined with 25, 60, 80 and 100 ppi cathodes. The operating conditions for this study were:

| | |
|---|---|
| Concentration range, mg/l (Au) | 2–20 |
| Current, Amp | 50 |
| pH | 12 |
| Flow rate, liter/minute | 4 |

Figure 5:
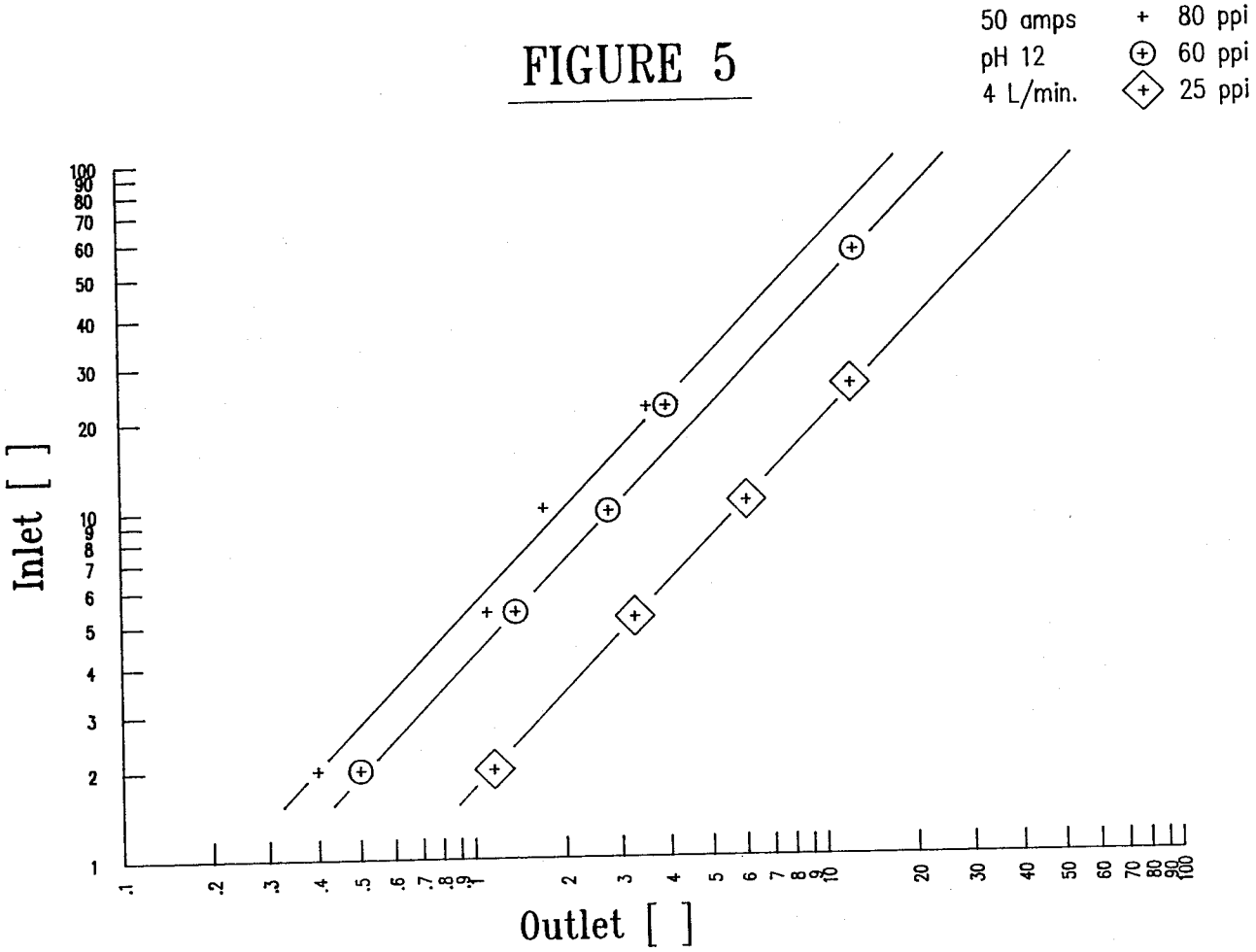
FIG. 5 and FIG. 6 are plots of gold recovery rates vs. inlet concentration for the electrolytic recovery system according to the present invention.
Figure 6:
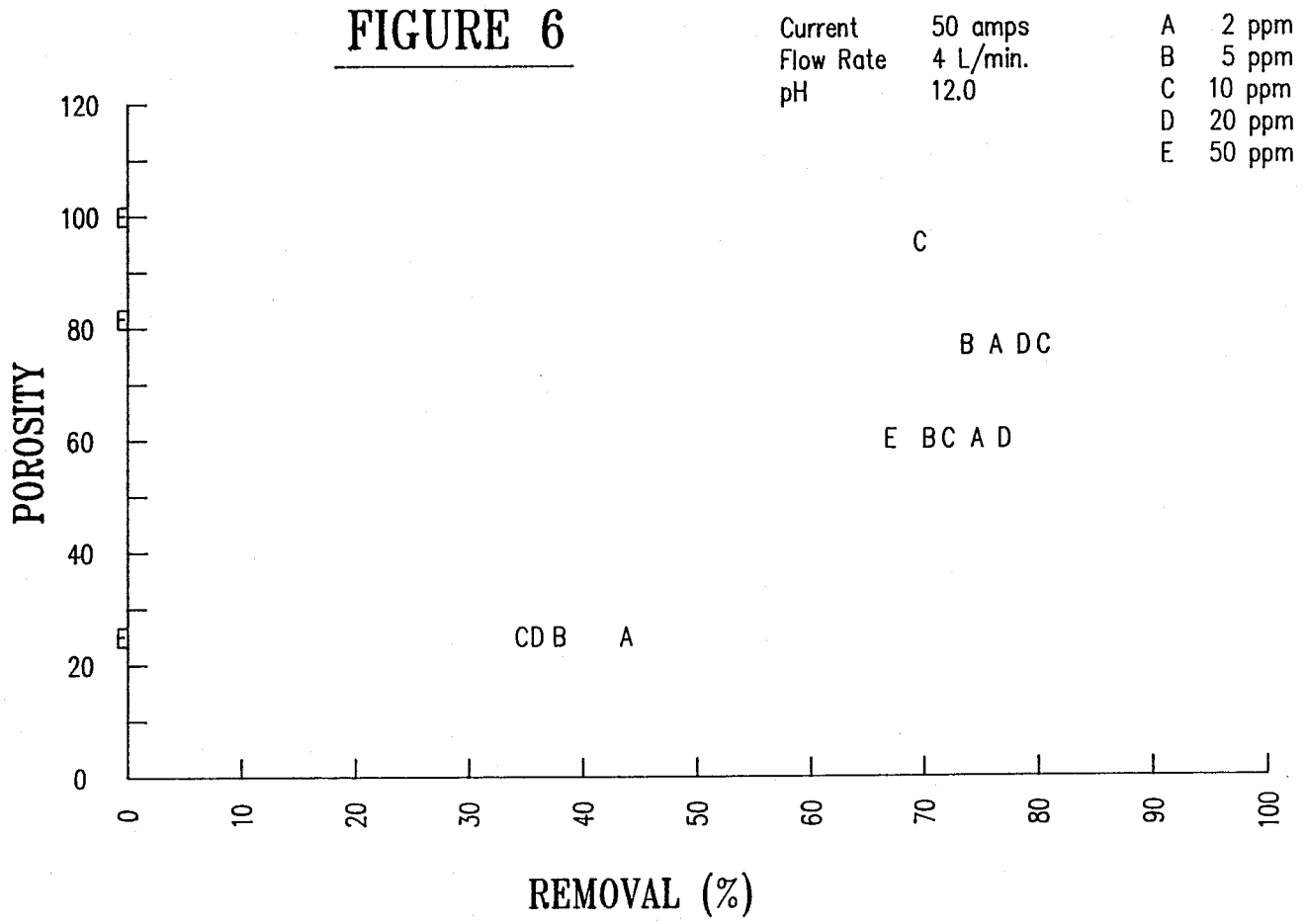

The recovery rates for the different porosities are shown in FIGS. 5 and 6. The recovery rates for the 60 ppi foam was 195–205% higher than the rates for the 25 ppi cathodes. The 80 to 100 ppi material had recovery rates comparable to the 60 ppi cathodes.

Flow rate vs. Recovery Rate

The recovery rates for two flow rates were determined for the following conditions:

| | |
|---|---|
| Concentrations, mg/l (Au) | 2 and 10 |
| Current, Amp | 35 |
| pH | 11.5 |
| Cathodes, pores/inch | 60 |

Figure 7:
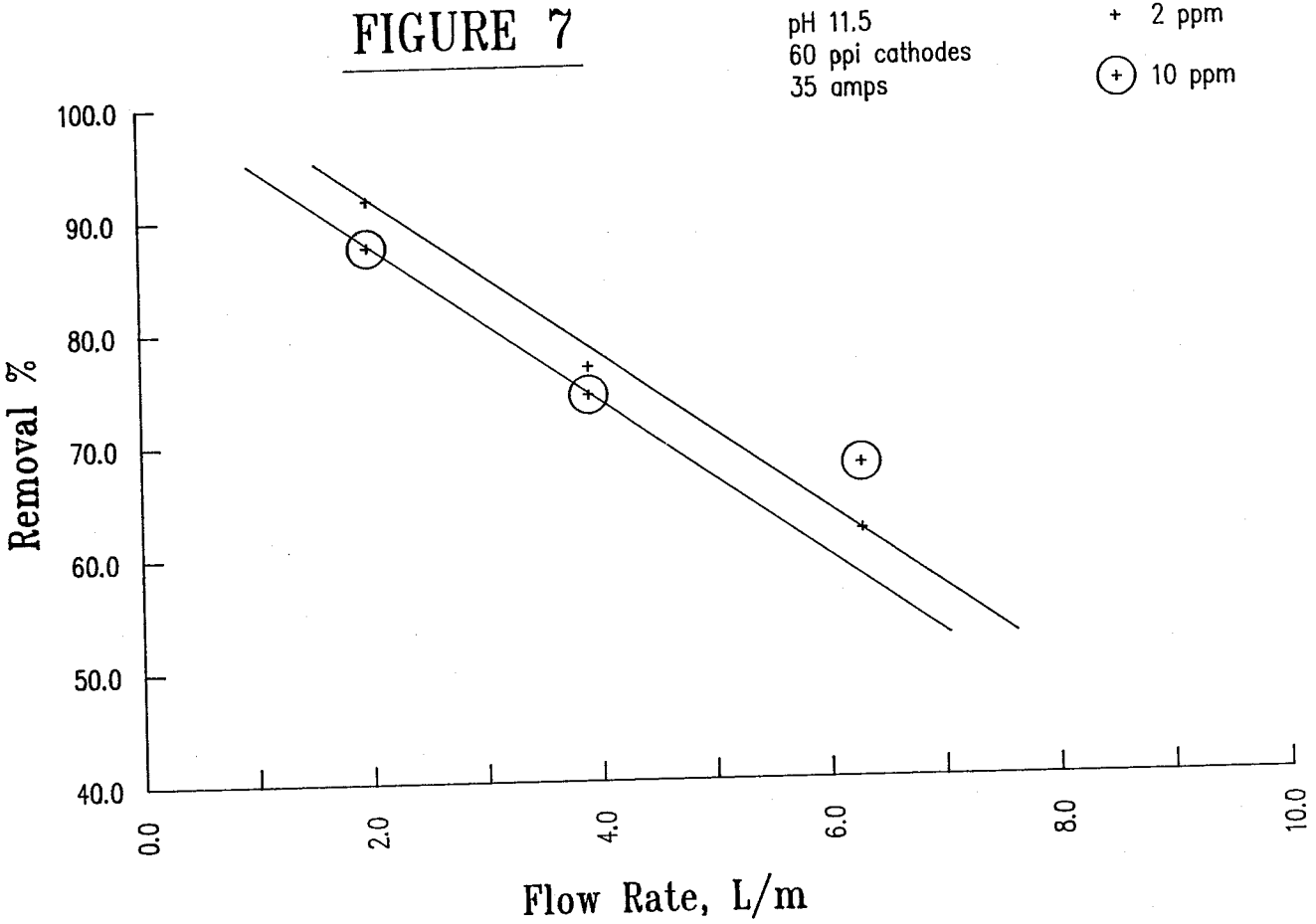
FIG. 7 is a plot of flow rate vs. recovery rate for the electrolytic recovery system according to the present invention.

The results are shown in FIG. 7. The recovery rate appears inversely proportional to the flow rate within the range studied. This plot indicates that recovery rates greater than 90% can be obtained when the flow rate is less than or equal to 2 liters/minute.

Recovery rates vs. pH

The recovery rates for pH values between 11–12 were determined with the following operating conditions:

| | |
|---|---|
| Concentration, mg/liter (Au) | 10 |
| Current, amp (Table I) | 35 (or maximum obtainable at an applied voltage of 6.0 V) |
| Flow rate liter/minute | 4 |
| Cathode, pore/inch | 60 |

Figure 8:
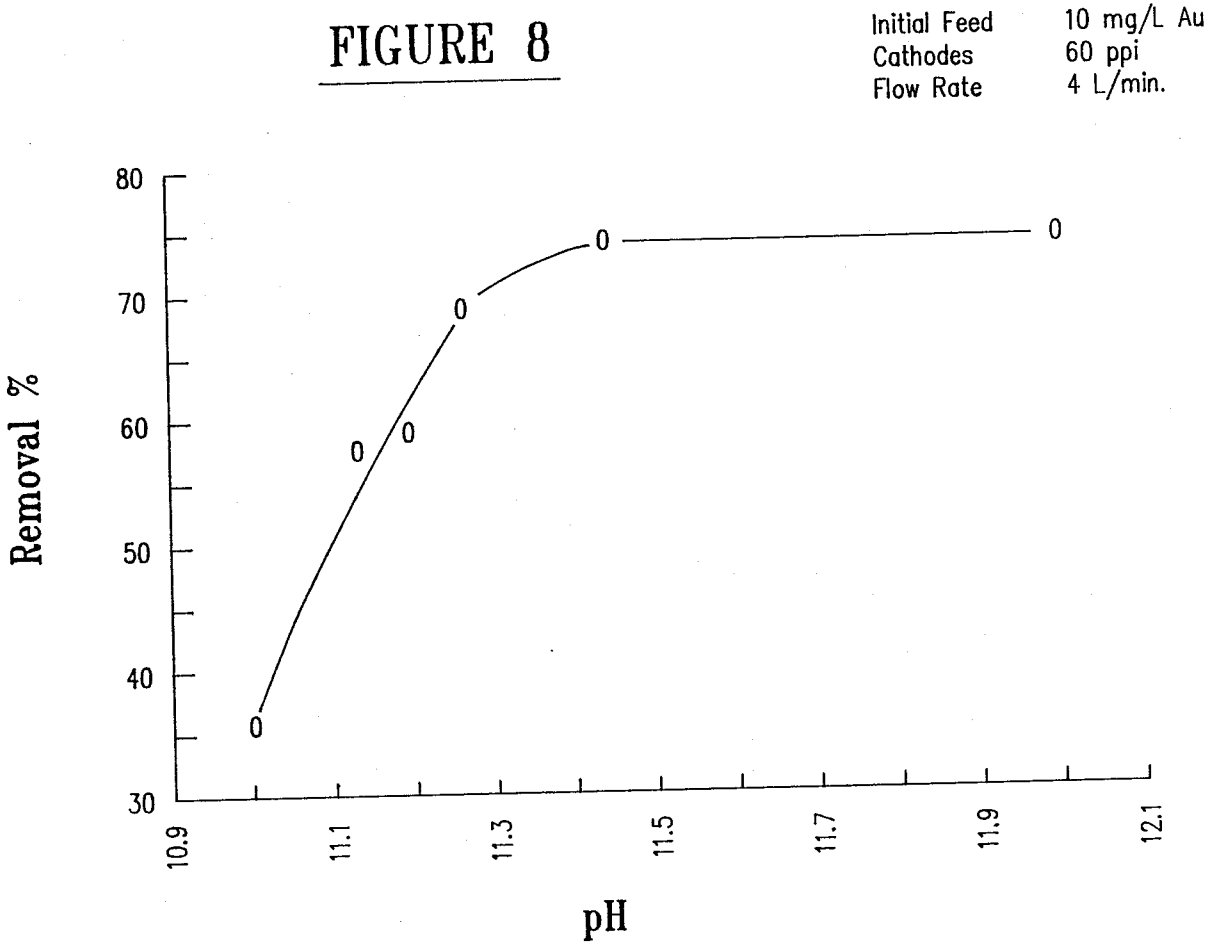
FIG. 8 is a plot of recovery rate vs. pH for the electrolytic recovery system according to the present invention.

The results are shown in FIG. 8. The maximum recovery rates were obtained for the pH values between 11.5–12.0. A significant decrease occurred at pH values below 11.3.

TABLE I

| Amperage vs. pH | |
|---|---|
| pH | Current |
| 11.0 | 12 |
| 11.15 | 20 |
| 11.20 | 25 |
| 11.30 | 35 |
| 11.50 | 35 |

Recovery rate vs. Current

The recovery rate was determined for current values which ranged between 5–50 amps. The operating conditions were:

| | |
|---|---|
| Concentrations, mg/l | 10 |
| pH | 11.3 |
| Flow rate, liter/minute | 4 |
| Cathodes, pores/inch | 60 |

Figure 9:
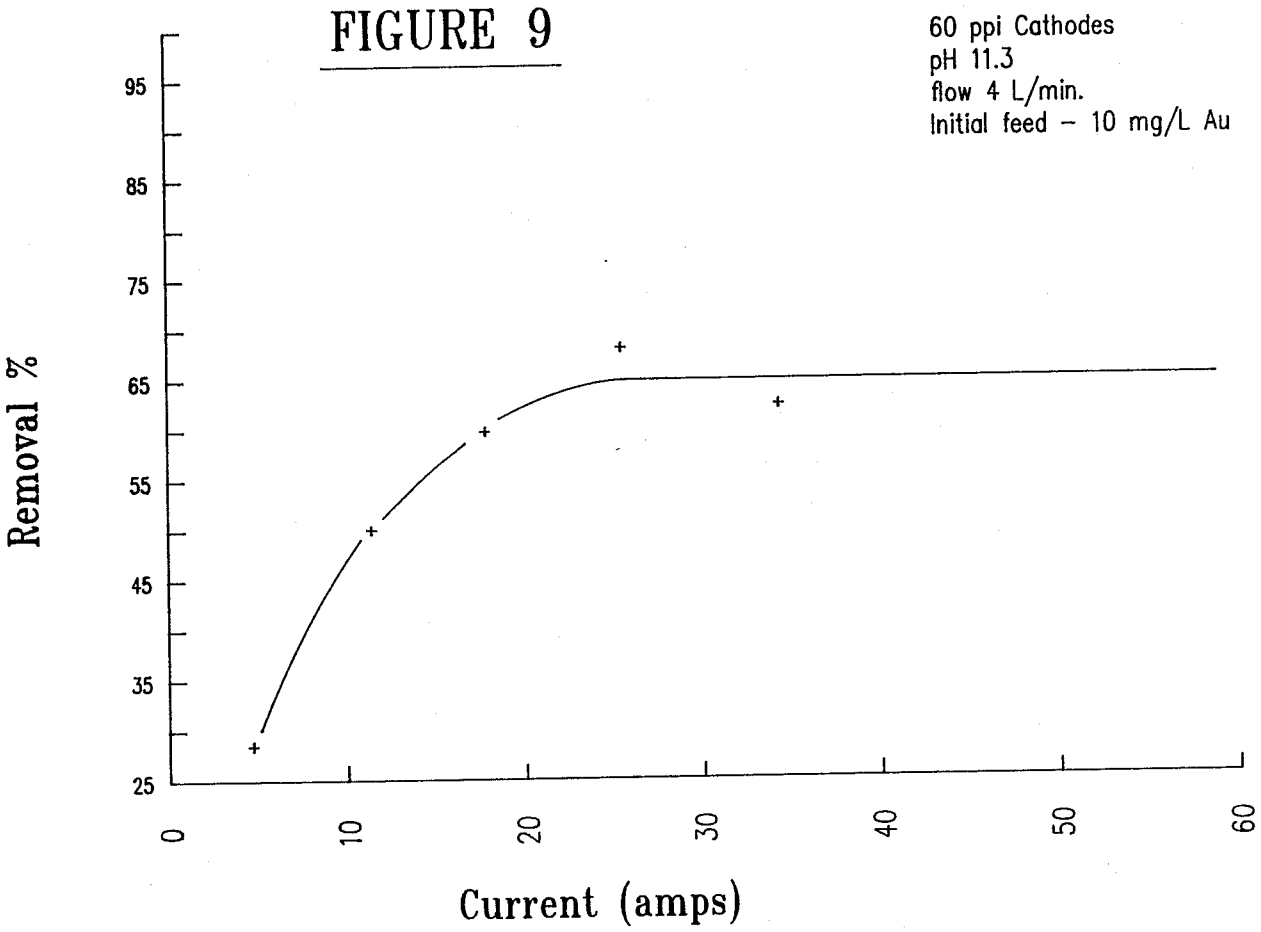
FIG. 9 is a plot of recovery rate vs. current for the electrolytic recovery system according to the present invention.

Results shown in FIG. 9 indicated that the recovery rate decreases sharply when the current decreases below 20 amps.

EXAMPLE II

The electrolytic recovery system according to the invention was further tested under three separate test conditions. A cell, as illustrated in FIG. 2, was utilized. The system contains two electrolytic cell units and each cell contained reticulate nickel cathodes, polyvinyl chloride distributor plates with 0.065" holes and a 1" outlet port. The solution tested contained dissolved gold.

Test 1

| Conditions: | |
|---|---|
| Volume of solution: | 30 gal. |
| Solution flow through cells: | Series |
| pH: | adjusted from 6.7 to 7.8 |
| Filter: | by-passed |
| Current Amps/Volts; | 30/4.5 |
| Circulation: | discharge to separate tank from feed |
| Cathodes: | 60 ppi Ni-each cell |

Figure 10:
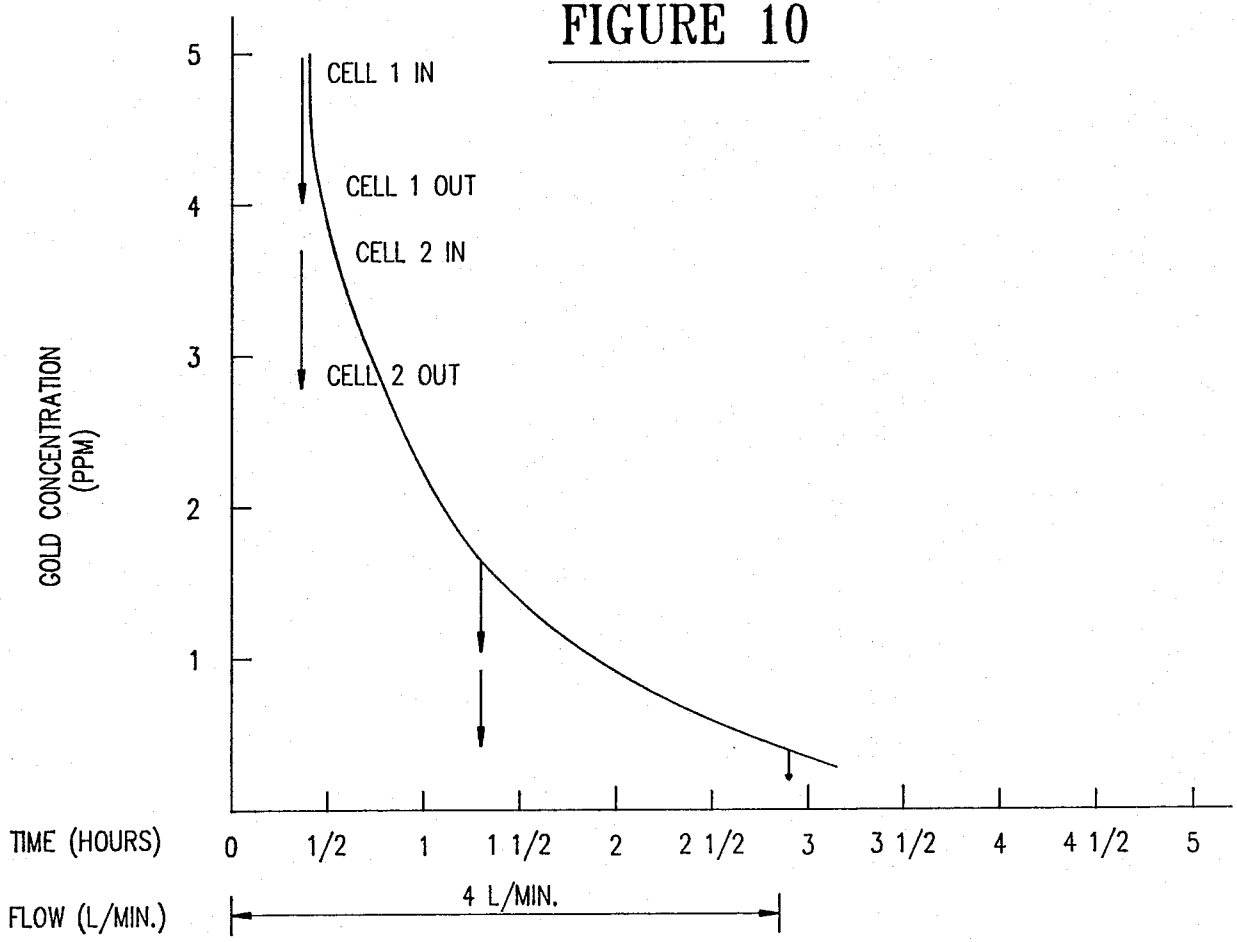
FIG. 10 is a plot illustrating the operation of the electrolytic system of the invention according to Example II, test 1.

The results from this test show high rate of deposition of the gold. The results are illustrated in the plot of FIG. 10.

Test 2

| | |
|---|---|
| Volume: | 33 Gal. |
| Solution Flow through Cells: | 1st 20 minutes through Cell 1 only, Remainder of the cells are in series |
| pH: | 4.6 not adjusted |
| Filter: | in operaton |
| Current Amps/Volts: | 30/4.2 |
| Circulation: | Discharge to separate tank from feed |
| Cathodes: | 60 ppi Ni-each cell |

Figure 11:
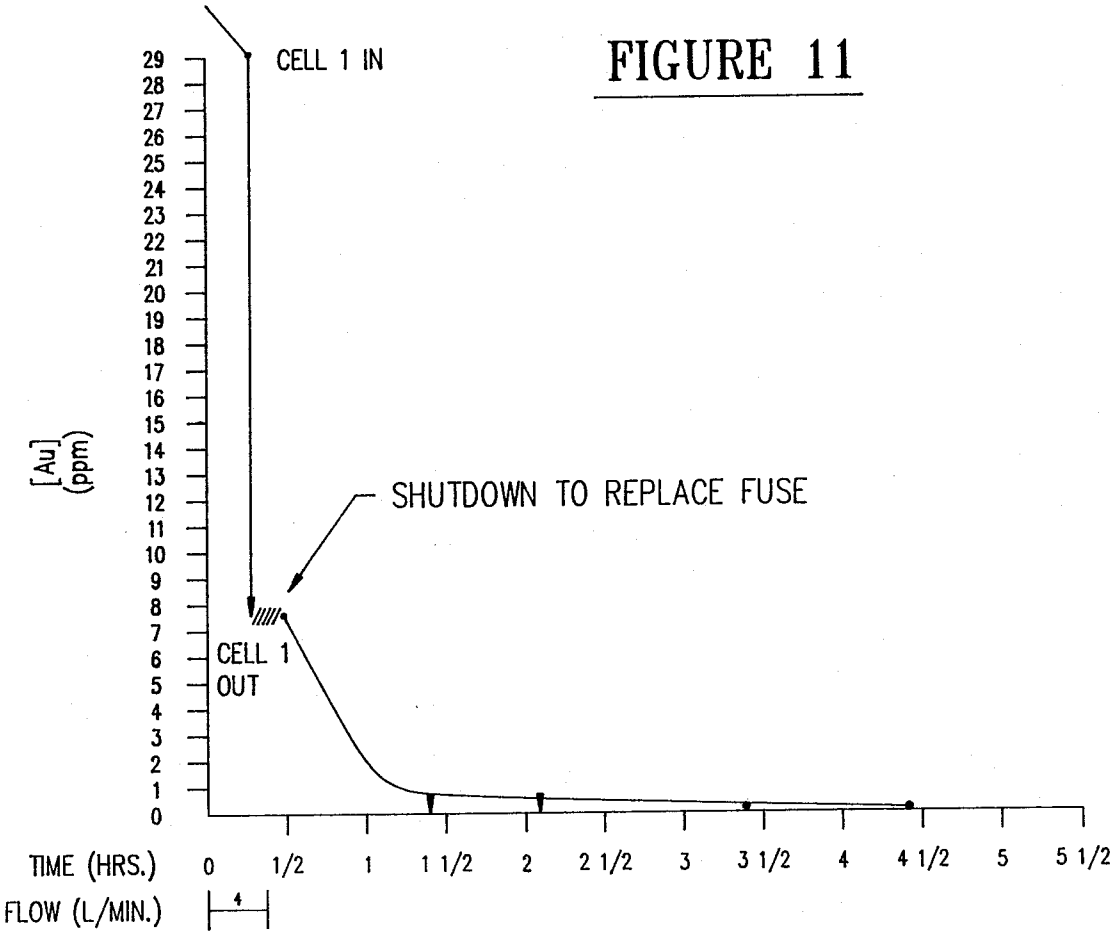
FIG. 11 is a plot illustrating the operation of the electrolytic system of the invention according to Example II, test 2.

The results from this test illustrate an even higher rate of deposition compared to that of Test 1 (note that this Test required a fuse replacement during operation). The results are shown in FIG. 11.

Test 3

| Conditions: | |
|---|---|
| Volume: | 24 Gal. |
| Solution Flow through Cells: | Series |
| pH: | Not Adjusted |
| Filter: | in Operation |
| Current Amps/Volts: | 30/3.5 |
| Circulation: | Discharge is Mixed with Feed in Internal Tank |
| Cathodes: | 60 ppi Ni-each cell |

Figure 12:
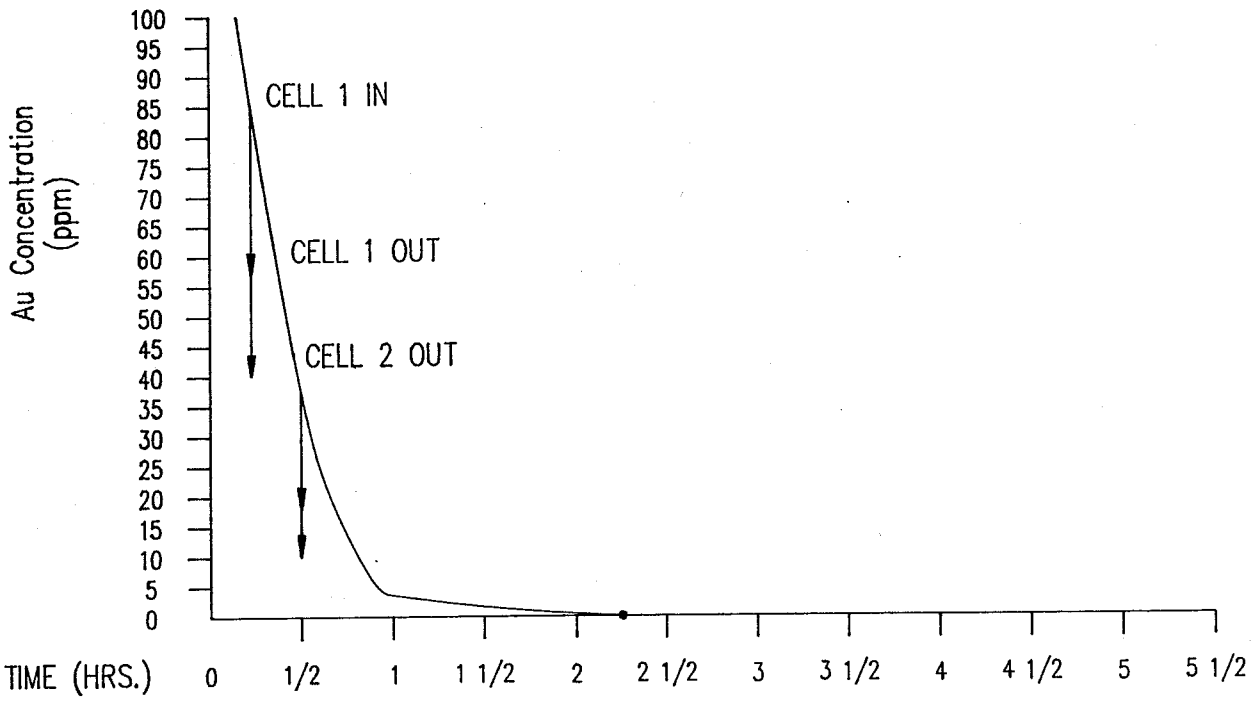
FIG. 12, is a plot illustrating the electrolytic system of the invention according to Example II, test 3.

The results from this test show almost complete deposition after only 1 hour of operation. The results are set out in FIG. 12.

While the invention has been described and illustrated with reference to certain preferred embodiments thereof, those skilled in the art will appreciate that various changes, modifications and substitutions can be made therein without departing from the spirit of the invention. For example, the specific cathode composition may be varied depending on the electrolyte and metal to be deposited on the cathode. It is intended, therefore, that the invention be limited only by the scope of the claims which follow.

What is claimed is:

1. An improved electrolytic system for the high rate of recovery of precious metals per unit of timing comprising:

a chemical agent reservoir comprising means for the addition of a controlled amount of said agent to a precious metal containing liquid for treatment;

two or more electrolysis cell units containing two or more flow through reticulated metal foam cathode assemblies and corresponding flow through foraminous anode assemblies; said cathode assemblies comprising:

cathodes arranged in a cartridge assembly, said cartridge comprising a handle, a single current lead for connection with an electrolysis cell and a plurality of conductive clips attached to said lead, said chips being capable of rigidly and conductively containing said cathodes wherein said handle is connected to and insulated from said lead; and switching means for effecting the connection of said two or more electrolysis cell units in series, in parallel or to by-pass at least one of said electrolysis cell units, wherein said switching means provides for the recovery of precious metals from very dilute precious-metal-containing liquid or from a high volume of liquid.

2. The system according to claim 1 wherein said chemical reservoir provides a means for precipitating contaminants and a means for adjusting the pH of said precious-metal-containing liquid for electrolysis; and said system further comprises filtering means for providing a substantially particulate free liquid filtrate for electrolysis.

3. The system according to claim 2 wherein said liquid is gold electroplating waste-water and said pH adjusting means establishes the pH of said waste water to at least 10.0.

4. The system according to claim 1 wherein said chemical agent reservoir comprises a salt source for treating said precious metal-containing liquid to provide in-situ formation of oxidizing agents for contaminants.

5. The system according to claim 1 wherein said electrolysis cell unit comprises a plurality of said reticulate metal foam cathodes formed by electroplating an electrically conductive open cell foam with a single deposit of metal in an amount sufficient to render said foam substantially as conductive as said metal, and to produce a relatively rigid reticulate through which said precious-metal-containing liquid initially flows with substantially negligible resistance so as to deposit said precious metal on said cathode.

6. The system according to claim 5 wherein said reticulate foam cathode is formed by electroplating an open cell polyurethane foam, having from about 10 pores per inch (ppi) to about 100 ppi, with a deposit of said metal selected from the group consisting of copper, nickel and zinc in an amount in the range of about 0.5 $g/ft^2$ to about 20 $g/ft^2$ of active area of said foam.

7. The system according to claim 6 wherein said metal is nickel.

8. The system according to claim 7 wherein said precious metals to be deposited on said cathode is selected from the group consisting of gold, silver and platinum.

9. The system according to claim 8 wherein said precious metal is gold.

10. The system according to claim 6 wherein the porosity of said cathode ranges from above 50 ppi to about 85 ppi.

11. The system according to claim 10 wherein the porosity of said cathode is about 60 ppi.

12. The system according to claim 1 wherein said system further comprises a blower for each electrolysis cell unit to remove any gases generated during the operation of the cell unit.

13. An efficient electrolytic system for the high rate of recovery of precious metals per unit of time comprising:

at least one containing means for establishing a controlled amount of precious-metal-containing liquid for treatment;

filtering means for providing a substantially particulate free liquid filtrate for electrolysis;

at least one electrolysis cell unit containing two or more flow through reticulated metal foam cathode asemblies and a flow through foraminuous anode assemblies;

feed means for recycling at least a portion of the electrolysis cell effluent for return to said containing means;

a pH adjusting means for adjusting the pH of said precious-metal-containing liquid for electrolysis;

a means for oxidizing cyanide ions present in said precious-metal-containing liquid to reduce the toxicity level of the electrolysis discharge effluent; and a means for monitoring the pH of the electrolysis discharge effluent wherein said means for monitoring pH comprises an alarm which is activated if the pH of said effluent reaches a predetermined pH.

14. The system according to claim 13 wherein said reticulated metal foam cathode assembly has a porosity of about 60 pores per inch (ppi) and the metal of said cathode is nickel.

15. A method for the efficient recovery of precious metal contained in a liquid medium, wherein said method comprises:

providing a precious-metal-containing liquid for treatment, said liquid containing precious metal in an amount sufficient for recovery;

feeding said precious-metal-containing liquid to a filtering means to obtain a precious-metal-containing filtrate;

feeding said precious-metal-containing filtrate to at least one electrolysis cell unit comprising two or more reticulated metal foam cathode assemblies and corresponding foraminuous anodes to effect the deposition of said precious metals on the cathodes; and returning at least a portion of the resulting precious-metal-depleted effluent after electrolysis for blending with fresh liquid.

16. The method according to claim 15 wherein said precious-metal-containing liquid contains cyanide and said liquid is further fed to a pH adjusting means to establish an alkaline pH for said liquid prior to feeding said liquid to said electrolysis cell unit.

17. The method according to claim 16 wherein said precious metal containing liquid is a waste water from gold electroplating wherein said waste water is adjusted to a pH of at least 9.5.

18. The method according to claim 17 wherein said waste water contains at least 1 ppm of gold.

19. The method according to claim 16 wherein at least a portion of said precious-metal-depleted effluent is fed to means for oxidizing said cyanide to reduce the toxicity of said effluent wherein said means contains an oxidizing agent.

20. The method according to claim 16 wherein said precious-metal-depleted effluent is fed to a means for monitoring the pH of said effluent wherein said means comprises an alarm which is activated if the pH of said effluent reaches a predetermined pH.

21. The method according to claim 15 wherein said reticulated metal foam cathode has a pore size of about 60 pores per inch (ppi) and the metal of said cathode is substantially nickel.

22. The method according to claim 15 wherein said system comprises at least two electrolysis cell units and a switching means for connecting said cell units in series, in parallel or for by-passing at least one of said cell units.

23. A cartridge assembly for containing electrodes in an electrolysis cell unit, said electrodes being reticulated metal foam cathode assemblies, wherein said assembly comprises a handle, a single current lead for connection with said electrolytic cell and a plurality of conductive clips attached to said lead, said clips being capable of rigidly receiving and conductively containing said cathodes wherein said handle is connected to and insulated from said lead.

24. The cartridge according to claim 23 wherein said reticulated metal foam cathode has a pore size in the range of about 10 ppi to about 100 ppi and the metal of said cathode is copper or nickel.

25. An improved electrolytic system for the high rate of recovery of precious metals per unit of time comprising:

a chemical agent reservoir comprising means for the addition of a controlled amount of said agent to a precious metal containing liquid for treatment, said resevoir providing an oxidizing agent source for oxidizing cyanide ions present in said precious metal-containing liquid to reduce the toxicity level of the electrolysis discharge effluent;

two or more electrolysis cell units containing two or more flow through reticulated metal foam cathode assemblies and corresponding flow through foraminous anode assemblies;

means for monitoring the pH of said electrolysis discharge effluent wherein said means for monitoring pH comprises an alarm which is activated if the pH of said effluent reaches a predetermined pH; and switching means for effecting the connection of said two or more electrolysis cell units in series, in parallel or to by-pass at least one of said electrolysis cell units, wherein said switching means provides for the recovery of precious metals from very dilute precious-metal-containing liquid or from a high volume of liquid.

26. The system according to claim 25 wherein said oxidizing agent is a hypochlorite salt.

27. An improved electrolytic system for the high rate of recovery of precious metals per unit of time comprising:

a chemical agent reservoir comprising means for the addition of a controlled amount of said agent to a precious metal containing liquid for treatment;

at least one containing means for said precious-metal containing liquid for treatment, said containing means being a tank which is provided with an overflow alarm, wherein said alarm is activated when the liquid contained in said tank reaches a predetermined level;

two or more electrolysis cell units containing two or more flow through reticulated metal foam cathode assemblies and corresponding flow through foraminous anode assemblies; and switching means for effecting the connection of said two or more electrolysis cell units in series, in parallel or to by-pass at least one of said electrolysis cell units, wherein said switching means provides for the recovery of precious metals from very dilute precious-metal-containing liquid or from a high volume of liquid.

* * * * *